United States Patent [19]

Fischer

[11] 4,380,331

[45] Apr. 19, 1983

[54] SHEET FEEDING AND ALIGNING APPARATUS FOR ROTARY PRINTING MACHINE

[75] Inventor: Hermann Fischer, Augsburg, Fed. Rep. of Germany

[73] Assignee: M.A.N.-ROLAND Druckmaschinen Aktiengesellschaft, Offenbach am Main, Fed. Rep. of Germany

[21] Appl. No.: 231,160

[22] Filed: Feb. 3, 1981

[30] Foreign Application Priority Data

Feb. 6, 1980 [DE] Fed. Rep. of Germany ..... 3004314

[51] Int. Cl.[3] ..... B65H 5/08

[52] U.S. Cl. ..... 271/11; 271/103; 271/106; 271/107; 271/118

[58] Field of Search ..... 271/100, 103, 104, 106, 271/102, 107, 117, 118

[56] References Cited

U.S. PATENT DOCUMENTS 1,715,360 6/1929 Harrold ..... 271/103
2,225,006 12/1940 Gudger ..... 271/103 X
3,430,949 3/1969 Herdeg ..... 271/103 X
3,702,698 11/1972 Schwebel ..... 271/103
3,764,133 10/1973 Gray ..... 271/107

FOREIGN PATENT DOCUMENTS 2313514 1/1975 Fed. Rep. of Germany .
2518220 2/1977 Fed. Rep. of Germany .

*Primary Examiner*—Richard A. Schacher
*Attorney, Agent, or Firm*—Frishauf, Holtz, Goodman & Woodward

[57] ABSTRACT

To insure accuracy in feeding a sheet of paper from an overlapped, shingled paper supply on a make-ready table, a suction pick-up picks up the sheet and moves it upwardly for a limited distance of about 1 mm before initiating the forward movement of the sheet to transfer it to a gripper mechanism of a printing cylinder or transport drum while, simultaneously, moving it transverse to the plane of the sheet to bring it into proper alignment with the drum or cylinder gripper mechanism.

10 Claims, 2 Drawing Figures

SHEET FEEDING AND ALIGNING APPARATUS FOR ROTARY PRINTING MACHINE

Figure 1:
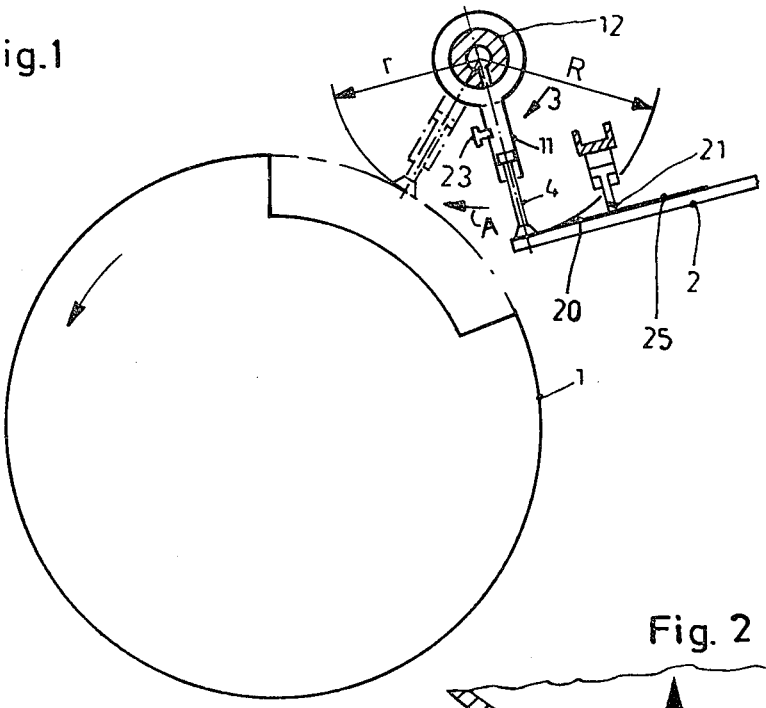

The present invention relates to printing machines, and more particularly to a sheet feeding and aligning apparatus to supply cut paper sheets to a sheet transport arrangement, especially to a transfer drum or a printing cylinder which has grippers thereon.

BACKGROUND

Various types of sheet feeding arrangements are known which use vacuum suction cups or other pick-up devices in which a topmost sheet from a stack is pulled off, supplied to a make-ready table in shingled, staggered overlapping relation where it is properly aligned with respect to a lateral and a front stop and is then supplied to a rotary printing transport apparatus, for example a printing cylinder, a transport drum or the like, by means of a rocking or reciprocating gripper (see, for example, German Published Patent Application DE-AS No. 25 18 220). The sheets are separated from the stack and then transported to the make-ready table by means of suction devices, transport rollers, transport belts and webs or the like. To then supply the partly overlapping sheets requires a gripper which reciprocates between the sheet on the make-ready table and the grippers on the transport device, typically a transport drum which is comparatively complex. The transfer gripper must be twice accelerated and retarded which results in substantial use of energy to overcome inertial forces. With the tendency to increase the speed of rotary printing machines, that is, with a higher through-put of sheets per unit time, the inertial forces of the gripper mechanism become considerable and interfere with operation of the gripper apparatus.

THE INVENTION

It is an object to provide a sheet gripper apparatus which picks up a single sheet from a make-ready table and supplies it to a further sheet transport apparatus, typically a printing cylinder or transport drum which provides for optimum separation of the sheets being supplied to the transport apparatus and which is simple, efficient, and reliable.

Briefly, the sheets are supplied to the make-ready table, in overlapping relation, and the apparatus, in accordance with the invention, includes means to control the pick-up motion of the pick-up element in steps, wherein a first step provides for pick-up of the leading edge of the sheet and lifting it off by a predetermined distance which is small, for example in the order of 1 mm; the thus lifted edge is then moved for the remaining pick-up distance required for engagement of the leading edge of the sheet with the gripper apparatus on the transport device of the printing machine, typically a transport drum or printing cylinder. The pick-up motion, being controlled to first pick up the sheet for a small distance before pulling the sheet off the make-ready table and transporting it to the printing machine transport apparatus, reduces adhesion of overlapping sheets, so that the mutual resistance against moving of the top sheet is reduced. Accelerating forces can be reduced since the sheet to be fed can be more easily pulled off from the make-ready table. The pick-up apparatus has grippers which first move only for a limited distance and then, during pull-off of the sheet, move for the remaining required distance. The combined movement of the grippers, typically suction cups which preferably telescope under vacuum within a guide tube, assists acceleration of the transfer grippers and of the sheet to reach the speed of the rotary drum.

Preferably, a hold-down device is provided to hold the sheet in aligned position to permit the pick-up mechanism to pick up the sheet and lift it by the aforementioned small distance before releasing the sheet for transport, thus insuring accuracy of pick-up and subsequent accuracy of alignment of the sheet on the transport device.

Suction cups for pick-up devices have been previously proposed—see, for example, German Published Patent Application DE-AS No. 23 13 514. As described, separating nozzles are used which are pulled radially inwardly, after pick-up of the first sheet, by vacuum against the pressure of a spring. This inward pick-up movement, however, is in a single step in the course of supplying a sheet from a make-ready table to the transport apparatus.

DRAWINGS

Figure 2:
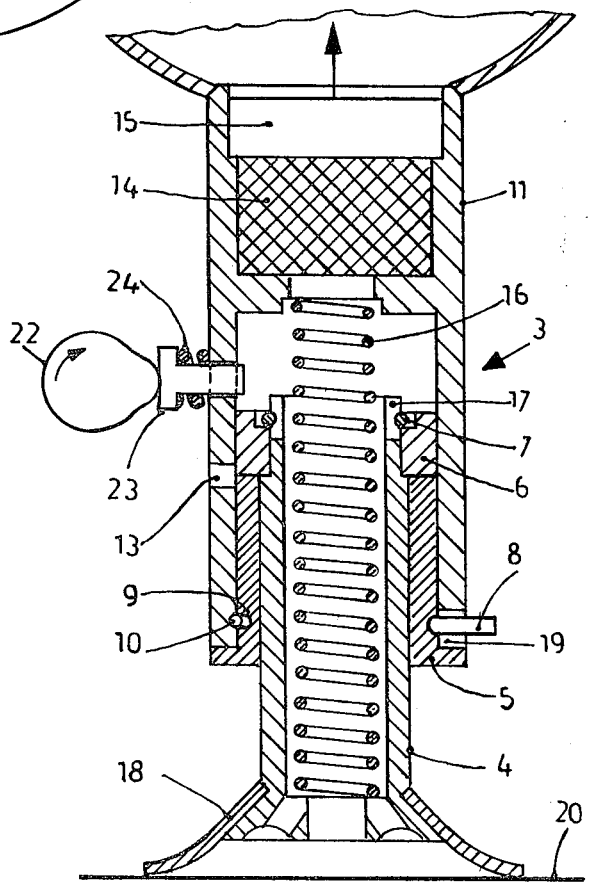

FIG. 1 is a highly schematic side view of a sheet transport apparatus in accordance with the invention; and FIG. 2 is a fragmentary vertical sectional view through a pick-up device, to a greatly enlarged scale.

A sheet 20, fed by a supply apparatus (not shown), is supplied to a make-ready table 2 so that it can be transported to a transport or printing drum or cylinder 1. A plurality of pick-up elements 3 are positioned to pick up the upper surface of the sheet being fed to the drum and positioned in appropriate alignment on the make-ready table 2 by suitable stops against which the sheet is placed.

The pick-up element 3—as best seen in the enlarged view of FIG. 2—includes a suction tube 4, guided in a bushing 5. The upper portion of the suction tube 4 has a small piston 6 secured thereto by a holding ring 7. Bushing 5 is secured by a spring 8 against undesired shifting. The spring 8 is positioned in a circumferential groove 9 in the lower portion of the bushing 5, as well as in a groove 10, formed at the inner circumference of the outer portion of a cylindrical housing 11. Preferably, the spring is a spiral spring having an end tang projecting through a hole 19 in the housing 11.

Housing 11 of the pick-up element 3 is arranged on a fixed hollow shaft 12. The housing 11 is positioned on the hollow shaft 12 to rotate or swing or rock with respect thereto. Vacuum is applied to the hollow shaft 12, which is then conducted to the interior of the pick-up elements 3. The pick-up elements 3 operate telescopically. A vent opening 13 is located at the central portion within the housing 11 leading to the interior thereof. An air filter 14 is preferably located in the upper portion of the housing 11 permitting vacuum to be applied from the hollow shaft 12 to the interior of the housing 11 while preventing ingress of fluff, dust or other contaminants to the hollow shaft. Use of the filter increases the operating reliability. Vacuum is applied from the hollow shaft through a supply chamber or manifold 15 and the air filter 14 into the interior of the housing 11. A pressure spring 16 is located in the hollow interior of the suction tube 4. The suction tube 4 terminates at its lower end in a suction cup 18, used to pick up a paper sheet. The upper portion of the suction tube 4 is formed with a longitudinal cut 17.

BASIC OPERATION

A sheet 20 fed to the make-ready table 2 is picked up by the suction cup 18. The piston 6 will now lift upwardly, due to vacuum applied through the hollow shaft 12 and the air filter 14. The cut 17 permits application of the vacuum over the entire surface of the small piston 6. Ambient air pressure is applied to the lower side of the small piston 6 by the vent opening 13. Air which is sucked up by the vacuum in the hollow shaft 12 is sucked through the filter 14 and the chamber or manifold 15, the filter 14 removing dust or other contaminants. The suction tube 4 is returned to the position shown in FIG. 2 by the spring 16 after transfer of the sheet to the gripper system (not shown) of the printing cylinder 1 and/or after the vacuum in the vacuum source, supplied by hollow shaft 12, is interrupted. The gripper system on the transfer drum or cylinder 1 may be of any well known and standard construction.

In accordance with the present invention, a locking element 23 is associated with each one of the grippers 3. The locking element 23 penetrates through the housing 11 and is controlled to operate in synchronism with rotation of the cylinder 1 by engagement with a cam 22, coupled to rotate in synchronism with the printing cylinder 1. The locking element 23, when the cam is as shown in the position in FIG. 2, penetrates into the interior of the housing 11, thus limiting the travel of the piston 6 of the suction tube 4 in its pull-in movement after gripping of a sheet 20. The locking element 23 is positioned on the housing 11 such that the suction tube 4, after gripping a sheet 20, is lifted by about 1 mm. This raises the sheet 20 by about 1 mm off the make-ready table 2 and provides for optimum separation of the sheet 20 from a next subsequent sheet 25 which follows sheet 20, in staggered, shingle-like overlapping arrangement.

The pick-up element 3 moves in the direction of the arrow A (FIG. 1) and as the pick-up mechanism so moves, the control cam 22 (FIG. 2) likewise rotates, so that the control land of the cam leaves the locking element 23 which is returned to projected position by a spring 24, so that its end will be flush with the interior of the housing 11, or slightly recessed with respect thereto. This permits pull-in of the suction tube 4 to such an extent that, upon continued rotation of the element 3, the sheet will be transported at a radius r from the center of the hollow shaft 12. Pull-in of the suction tube 4 into the housing 11 assists the acceleration of the element 3 so that the suction cup 18 and the sheet 20 held thereby are readily accelerated to the circumferential speed of the printing cylinder 1.

The pull-in motion of the suction tube 4 and the cylinder 6 connected thereto thus occurs in two steps: In a first step, the effective length of the element 3 is reduced from its normal extended radius R (FIG. 1) by about 1 mm, to lift the sheet 20 to be transported off a subsequent sheet 25, supplied longitudinally staggered with respect to sheet 20. This lift-off provides for optimum separation. In a further step, then, the effective length of the gripper 3 is reduced to the length r by final pull-in of the suction tube 4.

Changes in position of the already aligned sheet 20 can be obtained, in accordance with a preferred feature of the invention, by arranging a sheet holding device 21, located transversely across the make-ready table 2, and containing, for example, a holding rail which grips the sheet 20 for the time required until the suction cups 18 of the elements 3 have completely gripped the sheet, and, preferably, also have lifted off the leading edge by the aforementioned distance of about 1 mm. Thereafter, the sheet holding device 21 is lifted free, for example by pneumatic, hydraulic, electrical, or other suitable mechanism, thus completely releasing the sheet 20. This holding device 21 insures that sheets to be transported are gripped in appropriate alignment and with accurate register with respect to the printing steps to follow, for application to the printing cylinder 1 in accurately aligned position.

Various changes and modifications may be made; for example, the locking element 23 can be operated in various ways; rather than being operated by a control cam 22, an electrical locking device, for example including an electromagnet, a solenoid plunger or the like or a pneumatic cylinder may be used.

The sequence of operation is this: After a sheet 20 is delivered to the make-ready table, and there properly aligned, the hold-down device 21 clamps the sheet in position. The leading edge is picked up by the pick-up tube 4, and lifted off. Lock 23 is in the position shown in FIG. 2, so that the sheet, while being held by the hold-down device 21, is slightly lifted off the make-ready table. The alignment is maintained since the small distance of lift-off just provides for clearance withhout disturbing the alignment, which is insured by the hold-down divice 21.

The next sequence is the forward transport of the sheet and acceleration of the sheet to reach a linear speed which is at least approximately that of the circumferential linear speed of the grippers on the drum or cylinder 1. The hold-down device 21 is released, the pick-up element 3 is rotated in the direction of the arrow A, and the lock 23 is released so that, simultaneously, the sheet 20 will be pulled upwardly towards the center of the hollow tube 12 until it reaches the distance r and the appropriate transfer speed for transfer to the grippers on the drum or cylinder 1. During this pick-up, the next subsequent sheet can be fed to the make-ready table and properly aligned thereon and, since the leading sheet is being moved forwardly, the hold-down device 21 can hold down the next sheet upon having been aligned.

Of course, the full telescoping movement, after release of the lock 23, and thus complete pick-up of the sheet to the distance r, can be done independently of forward movement in the direction of the arrow A. For most rapid operation, these two movements can occur simultaneously.

I claim:

1. Sheet feeding and aligning apparatus to pick up a sheet (20) of a printing substrate, particularly paper, for transfer to a moving sheet transport mechanism and having a make-ready table (20);

a vacuum suction pick-up and sheet transport element (3) including a tubular housing (11);

a suction tube (4) movably guided in said housing for telescopic movement with respect thereto;

bias means (16) for biassing the suction tube (4) towards a sheet (20) to be gripped;

and pull-in means (6) for pulling the suction tube inwardly within the tubular housing upon adhesion of a sheet thereto under vacuum applied to the interior of said tubular housing (11), so that the pick-up element (3) will be of variable length, the pick-up element being positioned for engagement with the leading edge of the sheet (20) located on the make-ready table in aligned position and supported for pivoting movement for transporting a sheet after being picked up;

and comprising a locking element (23) selectively positionable in said housing (11) to contain telescoping pull-in motion of the suction tube within the tubular housing to a limited distance, and permit, after repositioning, continued telescoping movement of the suction tube within the tubular housing; and means for controlling the pick-up motion of the pick-up element (3) in steps (a) for pick-up of the leading edge of the sheet and lifting the sheet off the make-ready table (2) by the limited distance (R-1 mm) defined by the locking means by foreshortening said length by pulling in said suction tube for said limited distance; and then (b) for lifting the leading edge of the sheet for the remaining distance (R–r) and further foreshortening the pick-up element by further pulling in said suction tube upon repositioning of said locking means and pivotally moving said pick-up element to a position required for engagement with the transport mechanism and accelerating the sheet by moving the leading edge of the sheet in a rotary path as the element foreshortens to feed the sheet to said moving transport mechanism.

2. Apparatus according to claim 1, further comprising a guide bushing (5) slidably retaining said suction tube (4) in the housing (11).

3. Apparatus according to claim 1, further including control means (22, 24) selectively positioning the locking element (23) in the path of the tube, or out of the path of the tube, to permit, when positioned in the path of the tube, said limited movement and, upon removal from the path of the tube, full telescoping pull-in motion of the tube (4).

4. Apparatus according to claim 3, wherein the control means comprises a cam (22).

5. Apparatus according to claim 1, wherein the step (a) lifts the sheet (20) for the limited distance of about 1 mm.

6. Apparatus according to claim 1 further including a hold-down device (21) holding the sheet (20) in aligned and oriented position on the make-ready table until the sheet is picked up by said pick-up element.

7. Apparatus according to claim 6, wherein the hold-down device is pneumatically controlled.

8. Apparatus according to claim 1, wherein the transport mechanism to which the sheet is moved for further transport comprises a rotary cylinder or drum.

9. Apparatus according to claim 1, wherein the bias means for biassing the suction tube (4) towards a sheet (20) to be gripped comprises a spring (16).

10. Apparatus according to claim 1, wherein the pull-in means for pulling the suction tube inwardly within the tubular housing comprises a piston.

* * * * *